US006364467B1

(12) United States Patent
Blair et al.

(10) Patent No.: US 6,364,467 B1
(45) Date of Patent: Apr. 2, 2002

(54) BARRIER ISLAND STAGGER COMPENSATION

(75) Inventors: Dustin W. Blair; Hector Lebron, both of San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/849,097

(22) Filed: May 4, 2001

(51) Int. Cl.[7] ..... B41J 2/05; B41J 2/17
(52) U.S. Cl. ..... 347/65; 347/94
(58) Field of Search ..... 347/63, 65, 94

(56) References Cited

U.S. PATENT DOCUMENTS 5,463,413 A 10/1995 Ho et al. ..... 347/65
5,519,423 A * 5/1996 Moritz, III et al. ..... 347/65
5,608,436 A * 3/1997 Baughman et al. ..... 347/65
5,666,143 A * 9/1997 Burke et al. ..... 347/65
5,734,399 A 3/1998 Weber et al. ..... 347/65
5,793,393 A 8/1998 Coven ..... 347/65
5,912,685 A * 6/1999 Raman ..... 347/65
6,007,188 A 12/1999 MacLeod et al. ..... 347/65
6,042,222 A 3/2000 Moritz, III et al. ..... 347/65

* cited by examiner

*Primary Examiner*—John Barlow
*Assistant Examiner*—Juanita Stephens

(57) ABSTRACT

An ink jet printhead that includes a thin film substructure having heater resistors formed therein, an ink barrier layer disposed on the thin film substructure, a plurality of ink chambers formed in said ink barrier, a plurality of ink channels respectively connected to the ink chambers and opening towards an ink feed edge, and a plurality of barrier island located in respective ink channels. Each barrier island has a size that depends on the distance between an associated heater resistor and the ink feed edge.

24 Claims, 3 Drawing Sheets

BARRIER ISLAND STAGGER COMPENSATION

BACKGROUND OF THE INVENTION

The disclosed invention is generally directed to ink jet printheads employed in ink jet printers, and more particularly to printheads having an ink barrier architecture that compensates for ink chamber stagger.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *HEWLETT-PACKARD JOURNAL*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable print carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent the ink chambers. The ink drop generators are commonly arranged in columnar arrays that are adjacent respective ink feed edges. For reasons such as timing logic and electrical interconnection, the ink drop generators of a given column are staggered relative to the adjacent ink feed edge, wherein ink chambers are at differing distances from the ink feed edge.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The ink barrier layer is typically a polymer material that is laminated as a dry film to the thin film substructure, and is designed to be photodefinable and both UV and thermally curable. Ink is fed from one or more ink reservoirs to the various ink chambers around ink feed edges that can comprises sides of the thin film substructure or sides of ink feed slots formed in the substrate.

An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. No. 4,719,477 and U.S. Pat. No. 5,317,346, both of which are incorporated herein by reference.

Considerations with an ink jet printhead having staggered nozzles include variation in ink drop size along an ink drop generator column which adversely affects print quality.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
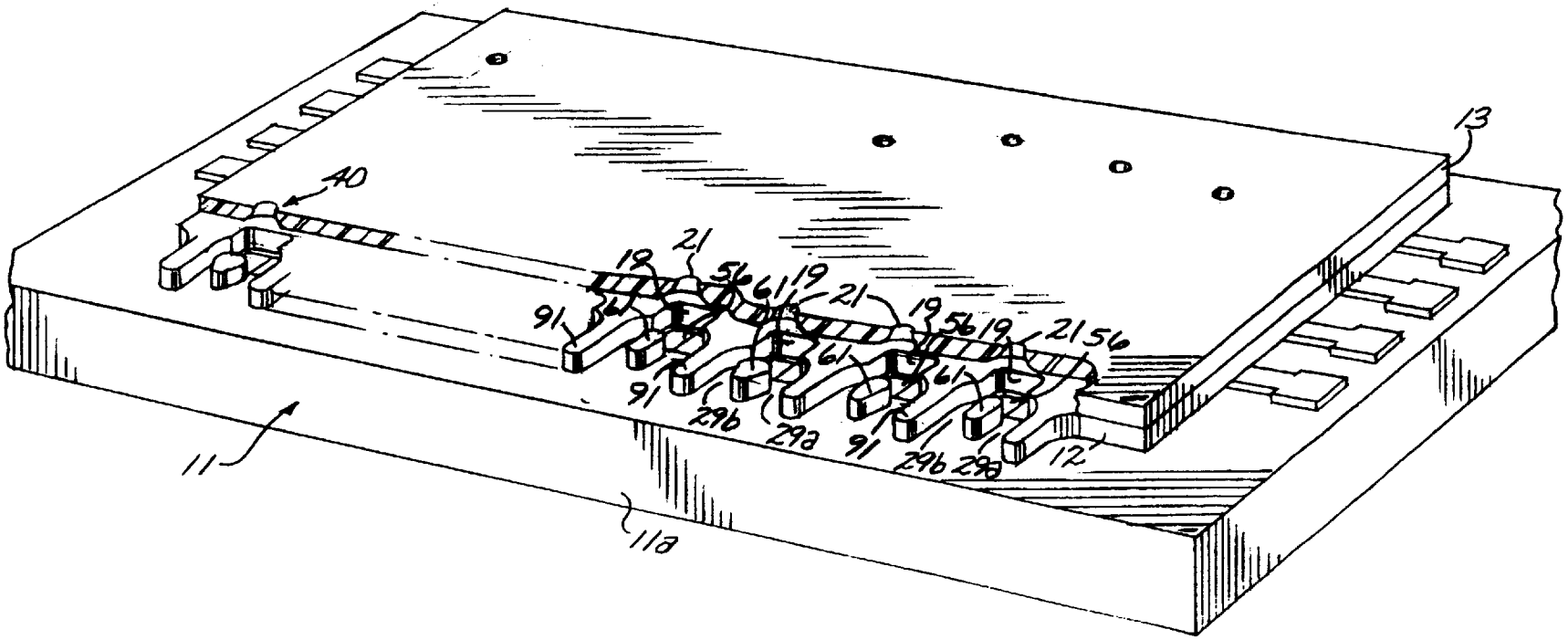
FIG. 1 is a schematic, partially sectioned perspective view of an ink jet printhead that employs the invention.

In the following detailed description and in the several figures of the drawing, like elements are identified with like reference numerals.

Referring now to FIG. 1, set forth therein is an unscaled schematic perspective view of an ink jet printhead in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 attached to the top of the ink barrier 12.

The thin film substructure 11 is formed pursuant to integrated circuit fabrication techniques, and includes thin film heater resistors 56 formed therein. By way of illustrative example, the thin film heater resistors 56 are located in columns along longitudinal ink feed edges 11*a* of the thin film substructure 11.

The ink barrier layer 12 is formed of a dry film that is heated and pressure laminated to the thin film substructure 11 and photodefined to form therein ink chambers 19 and ink channels 29*a*, 29*b*. Gold bond pads 27 engagable for external electrical connections are disposed at the ends of the thin film substructure 11 and are not covered by the ink barrier layer 12. By way of illustrative example, the barrier layer material comprises an acrylate based photopolymer dry film such as the Parad brand photopolymer dry film obtainable from E.I. duPont de Nemours and Company of Wilmington, Delaware. Similar dry films include other duPont products such as the "Riston" brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise, by way of further example, a plated metal such as nickel.

The ink chambers 19 in the ink barrier layer 12 are more particularly disposed over respective ink firing resistors 56 formed in the thin film substructure 11, and each ink chamber 19 is defined by the edge or wall of a chamber opening formed in the barrier layer 12. The ink channels 29*a*, 29*b* are defined by further openings formed in the barrier layer 12 and barrier islands 61, and are integrally joined to respective ink firing chambers 19.

The orifice plate 13 includes orifices 21 disposed over respective ink chambers 19, such that an ink firing resistor 56, an associated ink chamber 19, and an associated orifice 21 form an ink drop generator 40. By way of illustrative example, each orifice 21 can be offset relative to the associated heater resistor 56, wherein the orifice is not centered on the heater resistor.

Figure 2:
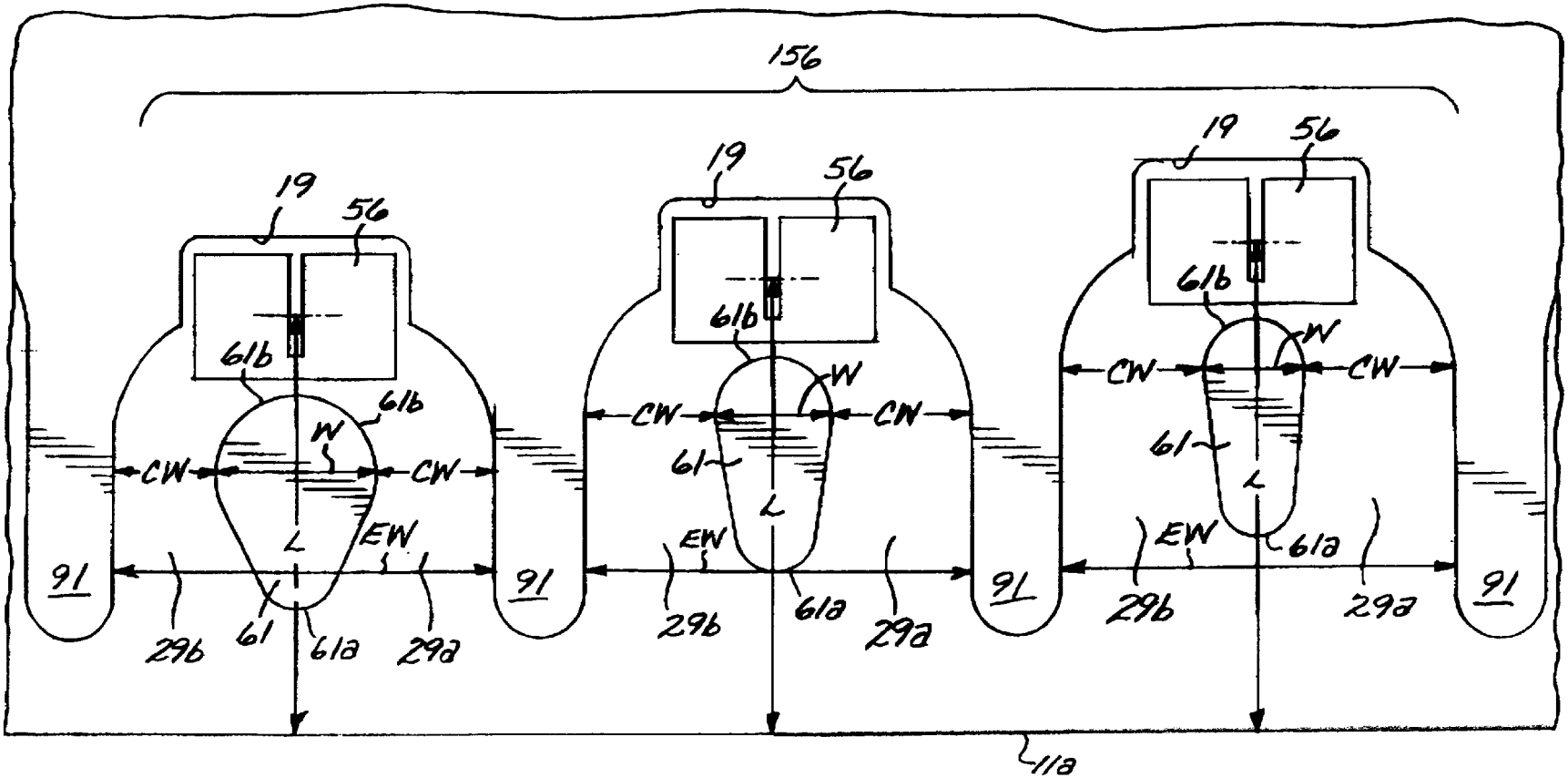
FIG. 2 is an unscaled schematic top plan view illustrating the configuration of a plurality of representative ink chambers, ink channels, and barrier islands of the printhead of FIG. 1.

FIG. 2 is an unscaled schematic top plan view illustrating the configuration of a plurality of representative ink chambers 19, associated ink channels 29, and barrier islands 61.

The heater resistors 56 are more particularly staggered so that their centers are positioned at different distances L from the ink feed edge 11*a*. Such distance L can be called the "shelf length" of a heater resistor. The ink chambers 19 and the nozzles 21 are similarly staggered.

By way of illustrative example, the heater resistors 56 are arranged in repeating groups 156 of three heater resistors 56, for example, wherein each heater resistor of a group 156 has a different shelf length L and wherein the shelf length of correspondingly located heater resistors in respective groups is substantially the same. In other words, the heater resistors 56 have different shelf lengths L, depending on their locations in a group.

Figure 3:
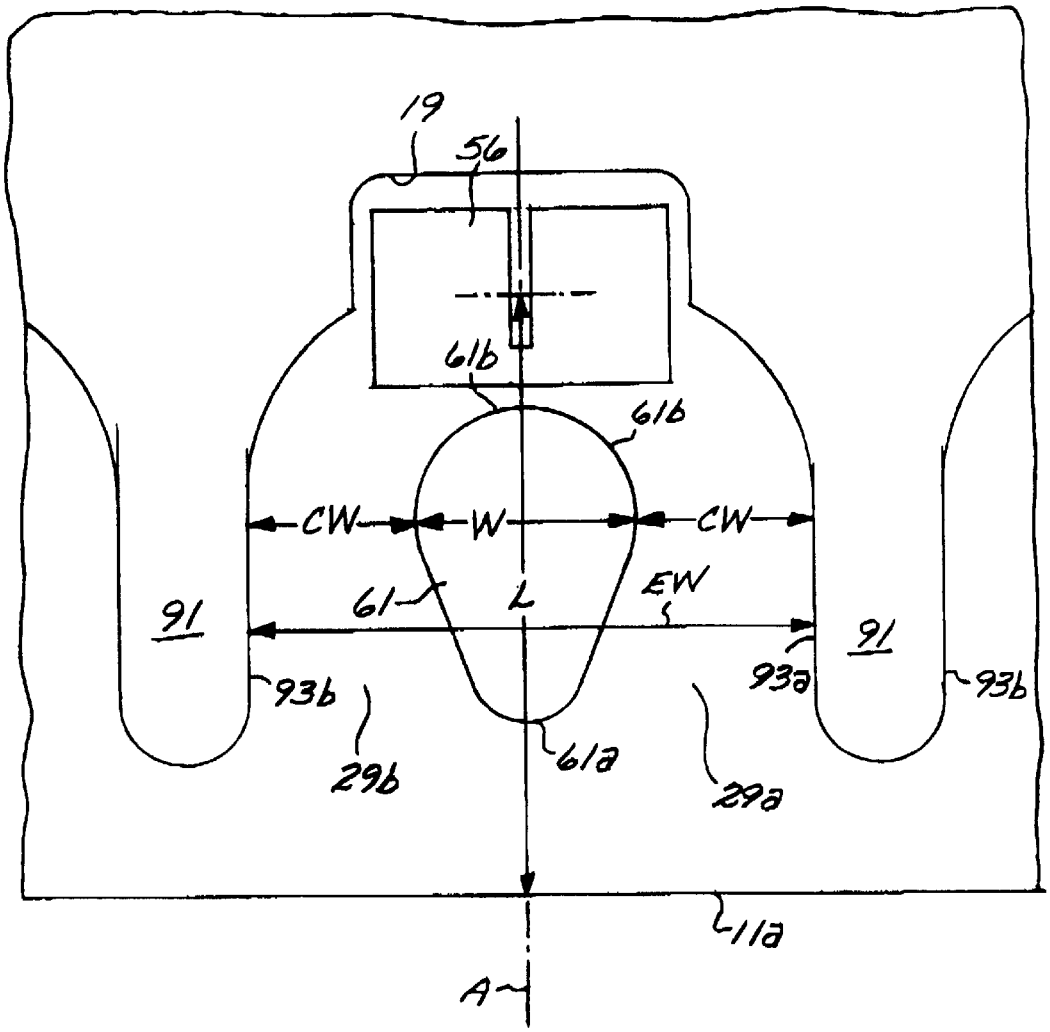
FIG. 3 is an unscaled schematic top plan view of a representative ink chamber and its associated barrier island and ink channels.

As shown in FIG. 3, the ink channels 29*a*, 29*b* associated with an ink chamber are formed by walls of barrier protrusions 91 that extend from regions between the ink chambers 19 toward the ink feed edge 11*a*. Each barrier protrusion 91 more particularly includes walls 93*a*, 93*b* that extend from the ink chamber toward the ink feed edge 11*a*. The walls 93*a*, 93*b* of a given protrusion 91 converge toward each other, and in this manner opposing walls 93*a*, 93*b* that extend toward the feed edge 11*a* and diverge from each other form outer sides of ink channels 29*a*, 29*b*. A barrier island 61 is located between opposing walls 93*a*, 93*b* so as to define the ink channels 29*a*, 29*b* which merge into the ink chamber 19. The distance EW between generally linear portions of such opposing walls 93*a*, 93*a* as measured parallel to the ink feed edge 11*a* is substantially the same for all ink chambers.

The size of each barrier island is more particularly selected to modulate or equalize the fluidic resistances of the ink channels that are of different lengths for the different shelf lengths. For example, the largest dimension W of a barrier island 61 as measured parallel to the ink feed edge 11*a* is selected as an inverse function of the shelf length L of the associated ink chamber, whereby the barrier island dimension W is increased as shelf length is decreased. Consequently, the channel width CW of each of the associated channels 29*a*, 29*b*, at its narrowest point, increases as the shelf length L increases. Channel width CW is thus a direct function of shelf length L. Effectively, the equivalent hydraulic diameter of each of the channels 29*a*, 29*b* is increased as channel length is increased to compensate for the different channel lengths, so that the fluidic resistances of the channels 29*a*, 29*b* for heater resistors of different shelf lengths can be substantially balanced.

By way of specific example, each barrier island 61 is egg-shaped having one end 61*a* that is of smaller radius that the other end 61*b*. By way of more specific example, the end of smaller radius is closer to and faces the ink feed edge 11*a*. An egg-shaped barrier island 61 can have an axis of symmetry A that is orthogonal to the ink feed edge 11*a* and can be considered a major axis. The dimension W is therefore orthogonal to the axis of symmetry, and can be considered a width of the barrier island 61.

As another example, the ink barrier islands can be circular, wherein the radius is selected as an inverse function of shelf length.

Generally, a size of the barrier island is selected as an inverse function of the shelf length so as to control the hydraulic diameter of each of the channels 29*a*, 29*b*.

The foregoing has thus been a disclosure of a barrier island structure for an ink jet printhead that can provide for improved frequency response control and more consistent ink drop volume modulation.

Although the foregoing has been a description and illustration of specific embodiments of the invention, various modifications and changes thereto can be made by persons skilled in the art without departing from the scope and spirit of the invention as defined by the following claims.

What is claimed is:

1. An ink jet printhead, comprising:

a thin film substrate having an ink feed edge and a plurality of heater resistors located at different distances from said ink feed edge;

respective ink chambers formed in an ink barrier layer over respective thin film resistors;

respective nozzles disposed over respective ink chambers and heater resistors;

two ink feed channels connected to each ink chamber and formed of opposing barrier walls connected to an associated ink chamber and a barrier island disposed between said opposing walls;

each barrier island having a size selected as an inverse function of a distance L between an associated heater resistor and said feed edge.

2. The ink jet printhead of claim 1 wherein each barrier island includes a curved end that is closest to the ink feed edge.

3. The ink jet printhead of claim 2 wherein each barrier island includes an axis of symmetry that is perpendicular to said ink feed edge.

4. The ink jet printhead of claim 1 wherein each barrier island includes a curved end that is closest to an associated ink chamber.

5. The ink jet printhead of claim 4 wherein each barrier island includes an axis of symmetry that is perpendicular to said ink feed edge.

6. The ink jet printhead of claim 1 wherein each barrier island is egg-shaped.

7. The ink jet printhead of claim 6 wherein each egg-shaped barrier island includes a first end having a first radius and a second end having a second radius that is greater than said first radius, and wherein said first end is closest to said ink feed edge.

8. The ink jet printhead of claim 6 wherein each egg-shaped barrier island includes an axis of symmetry that is perpendicular to said ink feed edge.

9. An ink jet printhead comprising:

a thin film substrate having an ink feed edge and a plurality of heater resistors located at different distances from said ink feed edge;

respective ink chambers formed in an ink barrier layer over respective thin film resistors;

respective nozzles disposed over respective ink chambers and heater resistors;

a pair of ink feed channels connected to each ink chamber and formed of opposing barrier walls connected to an associated ink chamber and a barrier island disposed between said opposing walls;

each ink feed channel having a hydraulic diameter that is selected as a direct function of a distance L between an associated heater resistor and said feed edge.

10. The ink jet printhead of claim 9 wherein said barrier island includes a curved end that is closest to the ink feed edge.

11. The ink jet printhead of claim 10 wherein said barrier island includes an axis of symmetry that is perpendicular to said ink feed edge.

12. The ink jet printhead of claim 9 wherein said barrier island includes a curved end that is closest to an associated ink chamber.

13. The ink jet printhead of claim 12 wherein said barrier island includes an axis of symmetry that is perpendicular to said ink feed edge.

14. The ink jet printhead of claim 9 wherein said barrier island is egg-shaped.

15. The ink jet printhead of claim 14 wherein said egg-shaped barrier island includes a first end having a first radius and a second end having a second radius that is greater than said first radius, and wherein said first end is closest to said ink feed edge.

16. The ink jet printhead of claim 14 wherein said egg-shaped barrier island includes an axis of symmetry that is perpendicular to said ink feed edge.

17. An ink jet printhead comprising:

a thin film substrate having an ink feed edge and a plurality of heater resistors located at different distances from said ink feed edge;

respective ink chambers formed in an ink barrier layer over respective thin film resistors;

respective nozzles disposed over respective ink chambers and heater resistors;

two ink feed channels connected to each ink chamber and formed of opposing barrier walls connected to an associated ink chamber and a barrier island disposed between said opposing walls;

each barrier island having a width W parallel to said ink feed edge that is selected as an inverse function of a distance L between an associated heater resistor and said feed edge so as to determine a hydraulic diameter for each of associated ink feed channels as a direct function of the distance L.

18. The ink jet printhead of claim 17 wherein each barrier island includes a curved end that is closest to the ink feed edge.

19. The ink jet printhead of claim 18 wherein each barrier island includes an axis of symmetry that is perpendicular to said ink feed edge.

20. The ink jet printhead of claim 17 wherein each barrier island includes a curved end that is closest to an associated ink chamber.

21. The ink jet printhead of claim 20 wherein each barrier island includes an axis of symmetry that is perpendicular to said ink feed edge.

22. The ink jet printhead of claim 17 wherein each barrier island is egg-shaped.

23. The ink jet printhead of claim 22 wherein each egg-shaped barrier island includes a first end having a first radius and a second end having a second radius that is greater than said first radius, and wherein said first end is closest to said ink feed edge.

24. The ink jet printhead of claim 22 wherein each egg-shaped barrier island includes an axis of symmetry that is perpendicular to said ink feed edge.

* * * * *